US007607275B2

(12) United States Patent
Elliott et al.

(10) Patent No.: US 7,607,275 B2
(45) Date of Patent: Oct. 27, 2009

(54) THREE-AROUND CUTTING PATTERN FOR TITLE ROOFING MATERIAL

(75) Inventors: Bert W. Elliott, Toledo, OH (US); Meghan L. Howard, Gahanna, OH (US); James F. White, Sylvania, OH (US)

(73) Assignee: Owens Corning Intellectual Capital, LLC DE (US)

( * ) Notice: Subject to any disclaimer, the term of this patent is extended or adjusted under 35 U.S.C. 154(b) by 739 days.

(21) Appl. No.: 11/176,599

(22) Filed: Jul. 7, 2005

(65) Prior Publication Data

US 2007/0006546 A1 Jan. 11, 2007

(51) Int. Cl.
*E04B 1/00* (2006.01)
*E04G 21/00* (2006.01)
*E04G 23/00* (2006.01)

(52) U.S. Cl. ..... 52/746.11; 156/260; 428/143; 52/749.12

(58) Field of Classification Search ..... 52/552, 52/105, 518, 528, 545, 519, 554, 557, 749.12, 52/746.11; 156/260; 428/143
See application file for complete search history.

(56) References Cited

U.S. PATENT DOCUMENTS 2,171,010 A 8/1939 Schuetz et al.
4,233,100 A * 11/1980 Cunningham et al. ..... 156/260
4,499,702 A 2/1985 Turner
4,775,440 A * 10/1988 Jennus et al. ..... 156/260
5,102,487 A 4/1992 Lamb
5,186,980 A 2/1993 Koschitzky
5,860,263 A 1/1999 Sieling et al.
5,916,103 A * 6/1999 Roberts ..... 52/552
6,038,826 A 3/2000 Stahl et al.
6,044,608 A 4/2000 Stahl et al.
6,220,329 B1 4/2001 King et al.
6,334,923 B1 1/2002 Koschitzky
6,419,780 B1 7/2002 Queisser
6,524,682 B1 * 2/2003 Leavell ..... 428/143
6,544,374 B2 4/2003 King et al.
6,679,020 B2 1/2004 Becker et al.
6,804,919 B2 10/2004 Railkar
6,986,299 B2 * 1/2006 White et al. ..... 83/76.1
2004/0144060 A1 7/2004 Becker et al.
2005/0000335 A1 1/2005 Freshwater et al.

* cited by examiner

*Primary Examiner*—Richard E Chilcot, Jr.
*Assistant Examiner*—Chi Q Nguyen
(74) *Attorney, Agent, or Firm*—James J. Dottavio; Joan N. Drew

(57) ABSTRACT

An apparatus and method for bundling shingles includes a sorting mechanism for separating and stacking shingles into multiple bundles of sorted shingles such that each bundle has a different repeating sequence of shingles.

4 Claims, 5 Drawing Sheets

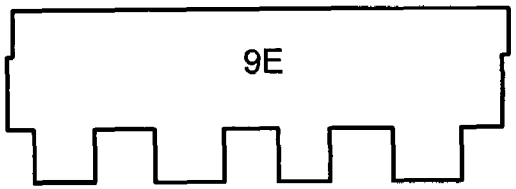
FIG. 9a
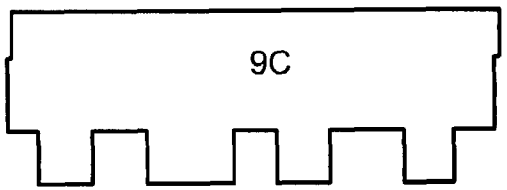
FIG. 9c
FIG. 9e
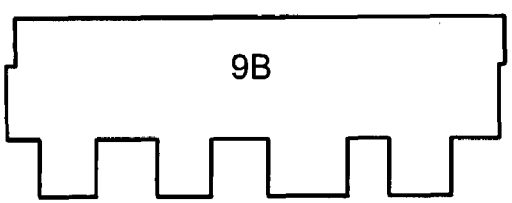
FIG. 9b
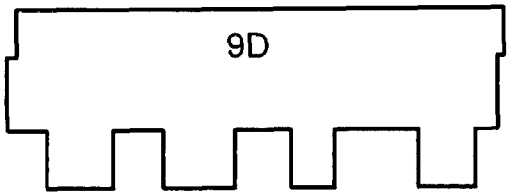
FIG. 9d
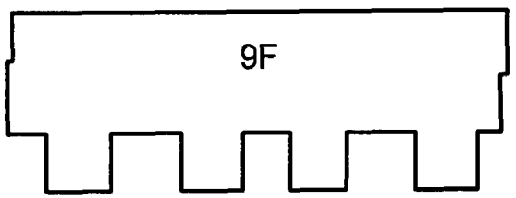
FIG. 9f

THREE-AROUND CUTTING PATTERN FOR TITLE ROOFING MATERIAL

TECHNICAL FIELD AND INDUSTRIAL APPLICABILITY OF THE INVENTION

This invention relates to asphalt-based roofing materials, and in particular to a roofing material having a staggered edge that is cut and stacked in a manner that allows the installation of such roofing materials to have a pleasing and random look.

Further, this invention pertains to manufacturing roofing shingles having tabs and cutouts. More particularly, this invention relates to engaging a shingle membrane, with a cutting cylinder to cut the membrane into discrete roofing shingles, particularly of the asphalt type, and to a method for insuring the appearance of randomness in the packaging of such shingles.

BACKGROUND OF THE INVENTION

It is well known in the roofing industry that irregularity or variation in shingle placement provides a roof that is esthetically pleasing and in popular demand. Mass produced asphalt roofing shingles of the ordinary three-tab variety, when placed on the roof, result in a roof which sometimes appears flat, dimensionless and uninteresting. Shingle manufacturers have attempted to provide a better look to such roofs by using variations in the thickness and in the tab cutout design of shingles. The goal is to produce a random looking sequence or pattern of shingles on the roof, similar to the appearance given by a roof shingled with wood shingles having varying widths, lengths and thicknesses.

Innovations to improve the random-like character of shingles include the use of a laminated shingle, which consists of an overlay having tabs and cutouts, and an underlay, which is usually rectangular. These laminated shingles can be produced in an offline system whereby the overlays are formed and cut and later mated with an already cut underlay for lamination. Another method of making laminated shingles involves an inline system in which continuous overlay and underlay strips are laminated together and then the laminated continuous strips are cut with an endcut cylinder into individual shingles.

Typical shingle manufacturing techniques include the use of a cutting cylinder positioned to engage the continuous shingle membrane and cut the design of the shingle. For a typical three-tab shingle, the cutting cylinder has a circumference the same length as the length of the shingle. In the case of a laminated shingle, where the cutting process and the lamination process occur prior to the end cutting process, the cutting cylinder does not divide the continuous shingle membrane into discrete roofing shingles. The laminated continuous membrane strips are cut into discrete roofing shingles by the endcut cylinder, positioned downstream from the cutting cylinder. The length of the shingle will always be the circumference of the endcut cylinder.

Where the cutting cylinder has a circumference equal to the length of the shingle, the relationship between the cutting cylinder and the length of the shingle is called a one-around system. Another system which may have been employed in the art is a two-around system, which uses a cutting cylinder with a circumference equal to twice the length of the shingles. With the two-around cutting cylinder, the cylinder cutting pattern can produce two distinct shingles with each revolution. In both the one-around and the two-around systems, the circumference of the cutting cylinder and the length of the shingle have a common factor, i.e., the length of the shingle.

The one-around and two-around systems are limited in that there are at most only four different shingles produced: the two patterns around the circumference and their complements.

The third type of sequencing between the cutting cylinder and the endcut mechanism is the near random type relationship, where the endcut cylinder does the end cutting, but the cutting cylinder circumference is not equal to, or a multiple of, the shingle length.

In this system the length of the shingle differs from the circumference of the cutting cylinder. The shingles will then be cut always in a different place, thereby creating a multitude of shingle patterns, approaching a random shingle pattern, but repeating after a large number of revolutions. For example, if the cutting cylinder is 40 inches in circumference, and the endcut cylinder (and the length of the shingle) is 39 inches, then the shingle pattern will repeat itself after producing approximately 39 shingles.

The fourth type of sequencing between the cutting cylinder and the endcut mechanism is the random relationship. In such a case, there is no specific relationship between the length of the shingle and the circumference of the cutting cylinder. In the random cutting system the shingles are endcut downstream from the cutting cylinder, and the endcut cylinder is not maintained in phase with the shingle pattern. The shingles will then be cut in different places, thereby creating truly random shingle patterns.

The random and near-random endcut practice produces some undesirable characteristics. First, the use of a random or near-random cut does not always produce a random looking roof when the shingles are applied. Second, the use of a random or near-random cut with a laminated shingle having tabs and cutouts can result in shingle tabs that are relatively narrow, such as being narrower in width than about 1.4 inches. It has been found that handling the shingle during the manufacturing process and during the installation process on the roof, where tabs are narrower than about 1.4 inches, can result in a tearing away of the tabs. This causes a maintenance problem in the plant and during installation, and alters the appearance of the shingle on the roof. It would be desirable to have a shingle-cutting pattern and system whereby shingle tabs are not made narrower than about 1.4 inches in order to prevent the breaking off of the narrow shingle tabs.

The U.S. Pat. No. 5,102,487 to Lamb and assigned to the common assignee as herein, describes a method and apparatus for manufacturing roofing shingles having tabs and cutouts where a cutting cylinder engages a membrane and cuts it into continuous strips. The circumference of the cutting cylinder and the length of the shingle have a common factor other than the length of the shingle. An endcut cylinder cuts the continuous shingle membrane strips into discrete roofing shingles, so that the pattern of tabs and cutouts will repeat itself periodically.

However, there is still a need in the industry to produce shingles that, when manufactured, cut, stacked and packaged, can be installed from their package in the order in which the shingles were stacked, and yet when installed, provide a pleasing and random effect. Accordingly, there is still a need for a method for manufacturing roofing materials which meets these needs.

SUMMARY OF THE INVENTION

The above objects as well as others not specifically enumerated are achieved by an asphalt-based roofing material and manufacturing method according to the present invention.

According to one aspect, the present invention relates to an apparatus and method for bundling roofing shingles which includes a mechanism for forming a plurality of discrete roofing shingles so that multiple patterns of shingles are formed, and a sorting mechanism for separating and stacking shingles into multiple bundles of sorted shingles, wherein each bundle has a different repeating sequence of shingles.

Various objects and advantages of this invention will become apparent to those skilled in the art from the following detailed description of the preferred embodiments, when read in light of the accompanying drawings.

BRIEF DESCRIPTION OF THE DRAWINGS

Prior art

Prior art

Prior art

Prior art

Prior art

Prior art

FIGS. 9*a*, 9*b*, 9*c*, 9*d*, 9*e* and 9*f* are schematic plan views, according to the principles of the invention, generally showing shingles made by a three-around repeating cylinder for use in making shingles that can be installed using a 5-inch offset installation pattern and/or a 5-inch-15-inch type offset installation pattern; FIG. 9*a* shows a first shingle having a first cut pattern "A"; FIG. 9*b* shows a second shingle having a second cut pattern "B"; FIG. 9*c* shows a third shingle having a third cut pattern "C"; FIG. 9*d* shows a fourth shingle having a fourth cut pattern "D"; FIG. 9*e* shows a fifth shingle having a fifth cut pattern "E"; and FIG. 9*f* shows a sixth shingle having a sixth cut pattern "F".

DETAILED DESCRIPTION AND PREFERRED EMBODIMENTS OF THE INVENTION

This invention will be described in terms of manufacturing a laminated, granule-covered asphalt shingle. It is to be understood that the principles of the invention could be employed with nonlaminated shingles and with shingles made of other materials.

Figure 1:
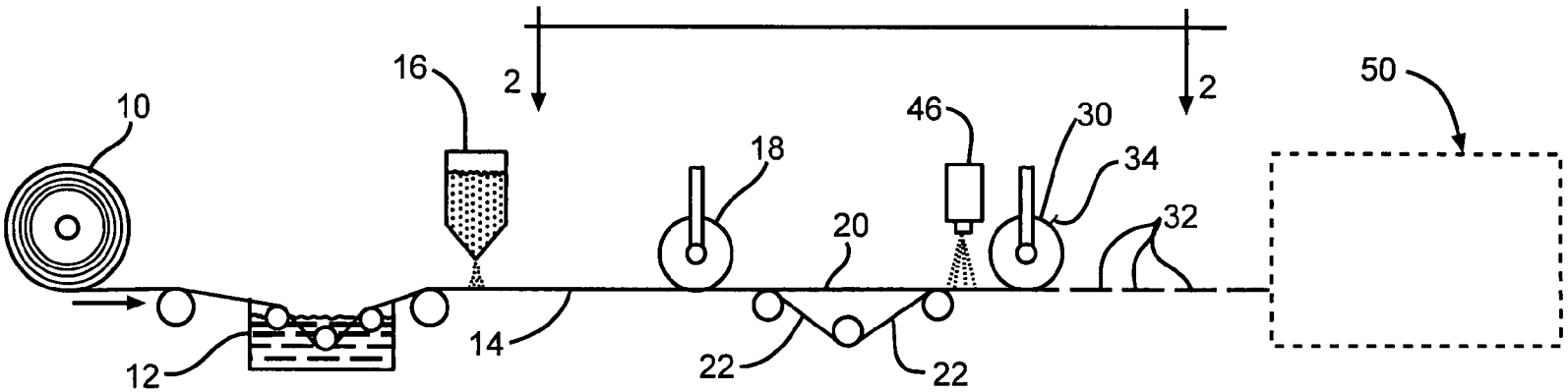
FIG. 1 is a schematic view, in elevation, of an apparatus for manufacturing roofing shingles.

As shown in FIG. 1, shingles are produced by feeding a glass fiber mat 10 through an asphalt coater 12 to produce a continuous shingle membrane 14. A granule applicator 16 applies supplies of granules to the top of the continuous shingle membrane 14 in the manner well known in the art.

Figure 2:
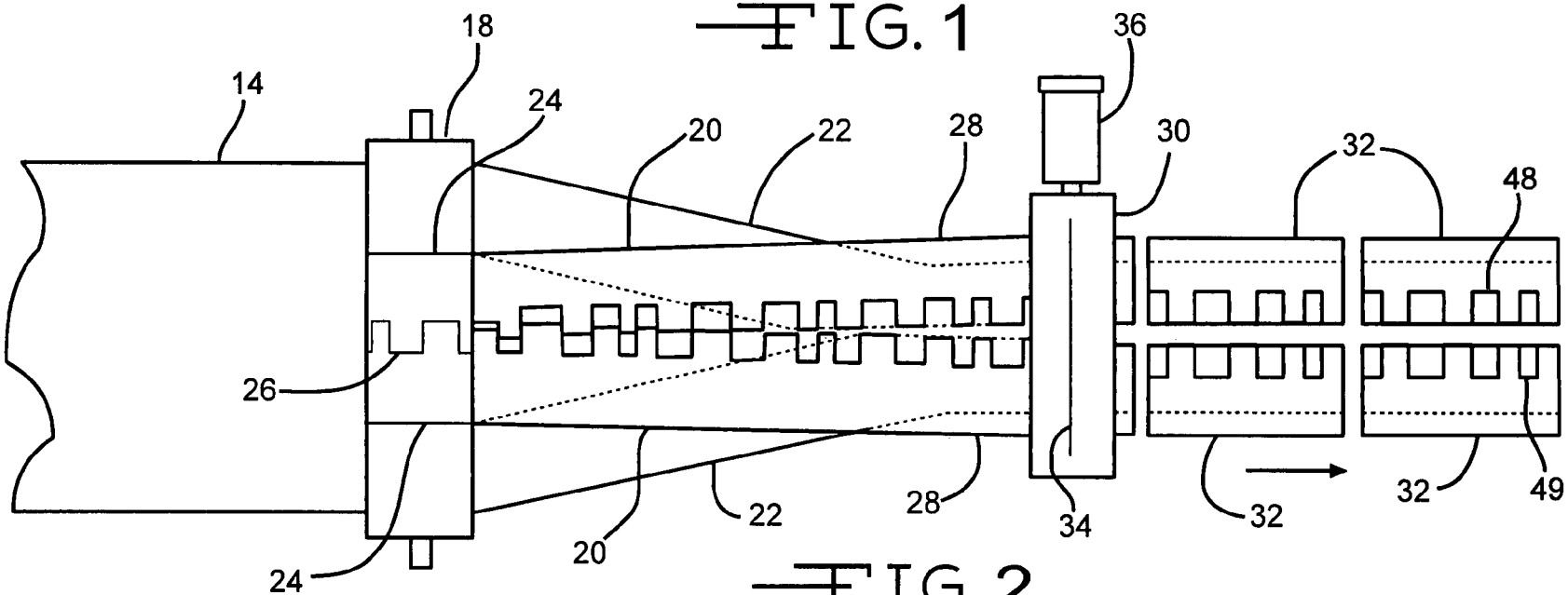
FIG. 2 is a schematic plan view of a portion of the apparatus of FIG. 1, including a cutting cylinder, an end cut cylinder and showing a lamination process.

In the embodiment shown in FIGS. 1 and 2, after a cooling process, not shown, the continuous membrane is fed along a path into engagement with a cutting cylinder 18 which engages the continuous shingle membrane 14 and divides it into continuous shingle membrane strips: overlay strips 20 and underlay strips 22. It should be understood, however, that the present invention is also useful for forming single layer shingles as well as multi-layer shingles and that such apparatus and method as described therein are within the contemplated scope of the present invention.

Referring again to the embodiment shown in FIG. 2, the cutting cylinder 18 is adapted with three blades: two straight blades 24 divide the underlay strips from the overlay strips; a patterned blade 26 cuts the overlay strip into two continuous membrane overlay strips 20 having the regular pattern of tabs and cutouts. The two continuous overlay strips 20 are complementary with the tabs of one strip matching or confirming to the shape of the corresponding cutouts of the other strip.

The underlay membrane strips 22 are positioned beneath the overlay membrane strips 20 and laminated together by a device, not shown, to produce laminated membrane strips 28. The device for joining the underlay strip and the overlay strip is well known in the art, and could include, for example, guiding conveyor belts, other guide members, an adhesive applicator, and means for pressing the underlay and overlay together. The laminated membrane strips 28 are fed into the endcut cylinder 30 which engages the laminated membrane strips 28 and divides the laminated strips 28 into discrete roofing shingles 32. The endcut cylinder 30 can be of any type suitable for cutting the laminated strips 28 into individual shingles 32. In the embodiment shown in FIG. 2, the endcut cylinder 30 has a blade 34 which is driven by a motor 36. Patterns of tabs 48 and cutouts 49 are produced by the revolutions of the cutting cylinder. It is understood that the term "cutout" is the space between two tabs. The cutout is formed by the complementary tab in the opposite half of the overlay membrane. As such, the discrete shingles 32 shown in FIG. 2 are laminated shingles having a saw-tooth overlay with tabs and cutouts on one edge, and having a generally rectangular underlay.

In certain embodiments, the shingle apparatus is adapted with sensor 46 which is connected to the endcut cylinder motor 36 in order to keep the endcut cylinder 30 in phase with the pattern produced by the cutting cylinder 18.

The sensor 46 can be an optical device which can sense the pattern of tabs and cutouts on the laminated membrane strips 28 and which can be adapted with a controller, not shown, to control the rotational speed of the endcut cylinder motor 36. Any other means suitable for maintaining the endcut cylinder rotation in phase with the shingle pattern also can be employed.

Figure 3:
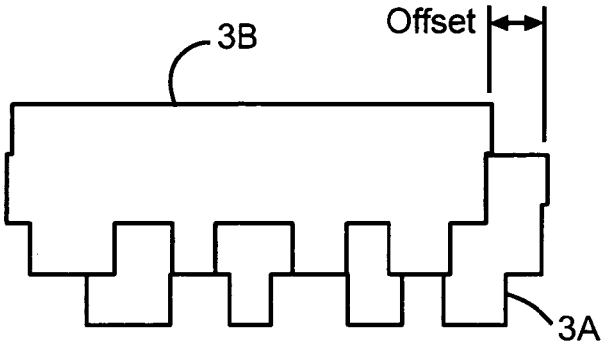
FIG. 3 Prior Art
FIG. 3 is a schematic plan view generally showing a prior art patterning with "offset" dimensions when an overlapping course of installed prior art shingles is shifted to one side.

Prior art FIG. 3 is a schematic plan view generally showing the "offset" dimension when an overlapping course 3B of installed shingles is shifted to one side relative to the previous course 3A. A proper shifting, or "offsetting", prevents vertical joints from lining up as the shingles are installed. Any vertical lining up of shingles is undesired since it is the appearance of randomness or lack of visual patterning of shingle placement that is aesthetically pleasing, and thus much desired by the customer. Also, vertical alignment provides a path for water to penetrate the roof system.

Figure 4:
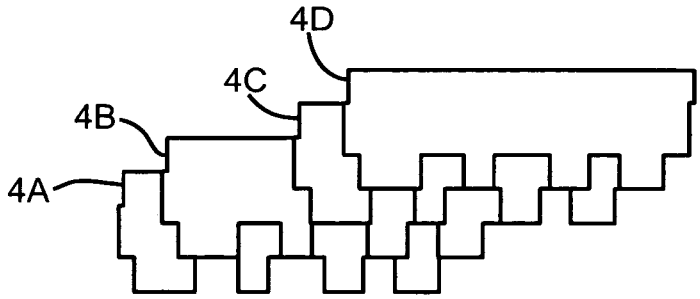
FIG. 4 Prior Art
FIG. 4 is a schematic plan view generally showing a prior art patterning with a 5-inch-15-inch offset installation pattern.

Prior art FIG. 4 is a schematic plan view generally showing an offset pattern which requires an overlapping course of installed shingles where the course of installation is shifted to one side at alternating offset lengths. As shown in FIG. 4, the required offset between shingles 4A and 4B and between shingles 4C and 4D is a first distance (for example, 5 inches), whereas the horizontal offset between shingles 4B and 4C is a second distance (for example, 15 inches). This alternating offset requirement requires that the installer keep track of the offset installing pattern and, also, measure each distance between adjacent shingles, i.e., measuring 5 inches, then 15 inches, 5 inches, 15 inches, etc.). This requires not only skill, but also additional time to install such shingle materials. Also, there is a waste of materials as each new row, or course, of shingles is laid.

In the manufacture of shingles for the 5-inch-15-inch offset pattern installation, the shingles for the 5-inch-15-inch offset pattern are made by using a one-around cutting cylinder that makes two interlocking or complementary, shingles. The first and second shingles are then sorted into separate lanes (not shown), one shingle pattern for each lane. These separate lanes are then sent to catchers (not shown) that stack the first shingles into first bundles (not shown) and the second shingles into second bundles (not shown). While there are two shingle patterns made, the first and second shingles are segregated by lane so that each bundle only has one pattern inside; thus, the requirement for the 5-inch-15-inch offset installation pattern in order to mix up the tab shapes on the roof.

Figure 5:
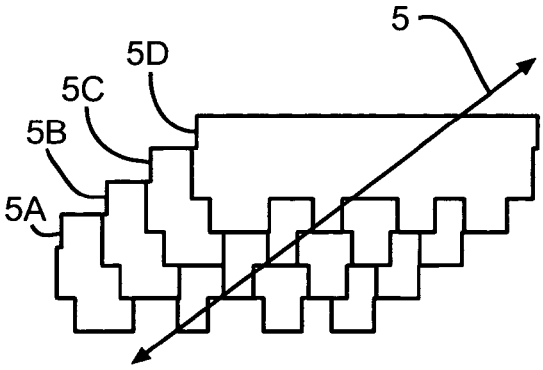
FIG. 5 Prior Art
FIG. 5 is a schematic plan view generally showing a prior art patterning with a 5-inch repeating offset installation pattern.

Prior art FIG. 5 is a schematic plan view generally showing a prior art offset pattern which requires an overlapping course of installed shingles where the course of installation is shifted to one side at repeating offset lengths. As shown in FIG. 5, the required horizontal offsets between shingles of successive courses 5A, 5B, 5C are at a fixed distance, such as 5-inch intervals. While this method of installation is quicker than the offset pattern shown in FIG. 4, the repeating 5-inch offset is more prone to unsightly tab patterns being seen moving up the roof, as indicated by the arrow 5. Also, the 5-inch repeating offset pattern requires the installer to keep track of the offset installing pattern and to measure each distance between adjacent shingles. This requires not only skill, but also additional time to install such materials. Also, there is a waste of materials as each new row of shingles is laid.

Figure 6:
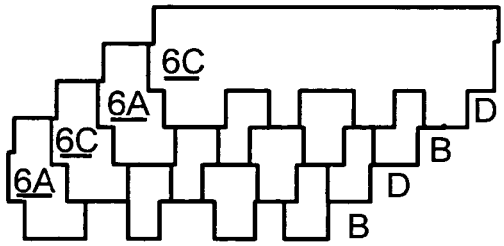
FIG. 6 Prior Art
FIG. 6 is a schematic plan view generally showing another prior art patterning with a 5-inch repeating offset installation pattern.

Prior art FIG. 6 is a schematic plan view generally showing an offset pattern which requires an overlapping course of installed shingles where the course of installation is shifted to one side at repeating offset lengths. As shown in FIG. 6, the required offsets are at 5-inch intervals. While this method of installation is quicker than the offset pattern shown in FIG. 4, the repeating 5-inch offset is more prone to unsightly tab patterns being seen moving up the roof. Also, the 5-inch repeating offset pattern requires the installer to keep track of the offset installing pattern and to measure each distance between adjacent shingles. This requires not only skill, but also additional time to install such materials. Also, there is a waste of materials as each new course of shingles is laid. In the manufacture of shingles for the 5-inch offset pattern installation, the shingles are made by using a two-around cutting cylinder that makes four interlocking, or complementary, shingles, A and B, C and D, two patterns for each lane.

Figure 7:
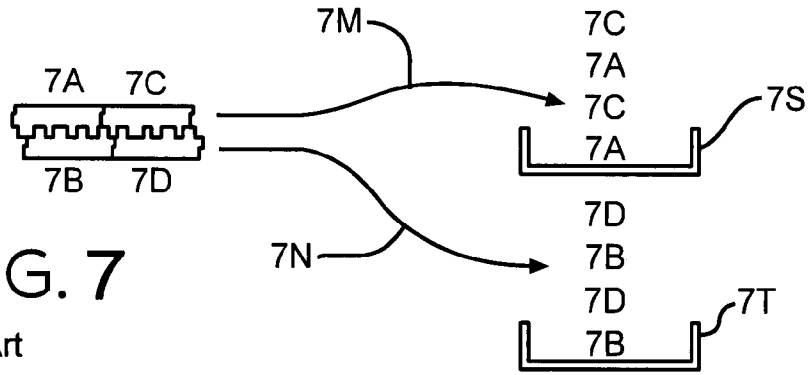
FIG. 7 Prior Art
FIG. 7 is a schematic plan view generally of a prior art process showing a method of separating and stacking shingles.

Prior art FIG. 7 is a schematic plan view generally of a process showing a method of separating and stacking shingles made by a two-around repeating cylinder for use in a 5 inch offset installation pattern shown in FIG. 6. FIG. 7 includes schematic plan views showing shingles made by a two-around repeating cylinder for use in a 5-inch offset installation pattern: a first shingle having a first cut pattern "7A"; a second shingle having a second cut pattern "7B"; a third shingle having a third cut pattern "7C"; and, a fourth shingle having a fourth cut pattern "7D".

The "7A" and "7C" shingles and the "7B and "7D" shingles are sorted into separate lanes 7M and 7N, as shown in FIG. 7, two shingle patterns for each lane. Shingles 7A and 7C from lane 7M are stacked into a first bundle 7S and shingles 7B and 7D from lane 7N are stacked into a second bungle 7T. The shingles are stacked over one other inside the bundle so that when these shingles are installed on the roof, there are typically no cases where adjacent identical shingles are positioned intermediately in the same horizontal shingle course. While there are four shingle patterns made, the shingles are segregated by lane so that each bundle only has two patterns inside; thus, the requirement for the 5-inch repeating offset installation pattern in order to mix up and randomize the tab patterns on the roof.

Figure 8:
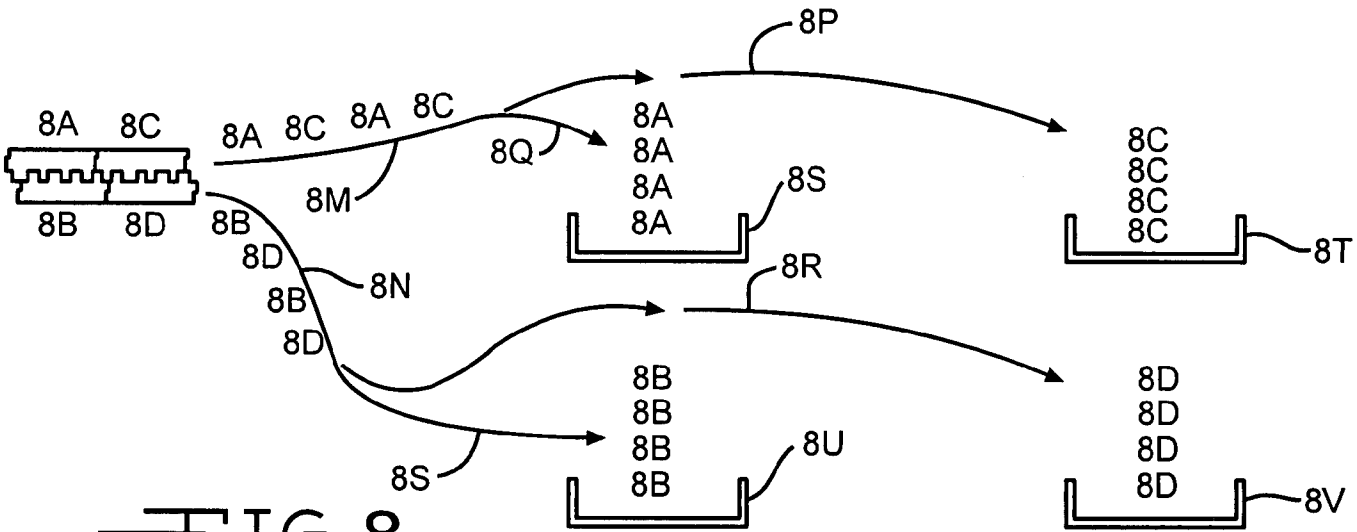
FIG. 8 Prior Art
FIG. 8 is a schematic plan view generally of a prior art process showing a method of separating and stacking shingles.

In certain processes, the use of four catchers is desired in order to speed up the "through-put" of the shingles as they are being manufactured and bundled. The use of the four catcher sorting process, however, causes the problem that the shingles are re-segregated into bundles having only one shingle pattern. Prior art FIG. 8 is a schematic plan view generally of a process showing a method of separating and stacking shingles made by a two-around repeating cylinder for use in a 5 inch offset installation pattern where the shingles are sent to four catchers. FIG. 8 includes schematic plan views generally showing shingles made by a two-around repeating cylinder for use in a 5-inch offset installation pattern: a first shingle having a first cut pattern "8A"; a second shingle having a second cut pattern "8B"; a third shingle having a third cut pattern "8C"; and, a fourth shingle having a fourth cut pattern "8D". The cut shingles are divided into lanes 8M and 8N. Lane 8M is divided into lanes 8P and 8Q; lane 8Q delivers the shingles 8A to catcher 8S while lane 8P delivers the shingles 8C to catcher 8T. Similarly, lane 8N is divided into lanes 8R and 8S; lane 8R delivers shingles 8B to catcher 8U while lane 8S delivers shingles 8D to catcher 8V. As a result, it is not possible to use this method to generate bundles of shingles that can benefit from the use of a 5 inch offset installation pattern.

FIGS. 9*a*, 9*b*, 9*c*, 9*d*, 9*e* and 9*f* are schematic plan views of shingles made by a process according to one aspect of the present invention. The FIGS. 9*a*-9*f* show shingles made by a three-around repeating cylinder. The three-around cylinder forms shingles having multiple, and in this embodiment, six distinct patterns: shingles 9A through 9F, with 9A, 9C and 9E being complementary with 9B, 9D, and 9F, respectively. These distinct shingles can be installed using a 5-inch offset installation pattern and/or a 5-inch-15-inch type offset installation pattern. FIG. 9*a* shows a first shingle having a first cut pattern "9A". FIG. 9*b* shows a second shingle having a second cut pattern "9B". FIG. 9*c* shows a third shingle having a third cut pattern "9C". FIG. 9*d* shows a fourth shingle having a fourth cut pattern "9D". FIG. 9*e* shows a fifth shingle having a fifth cut pattern "9E". FIG. 9*f* shows a sixth shingle having a sixth cut pattern "9F". The multiple distinct shingle patterns provide a greater appearance of randomness when the shingles are installed on the roof, thereby avoiding undesirable patterning, while increasing the aesthetic appearance of the roof.

Figure 10:
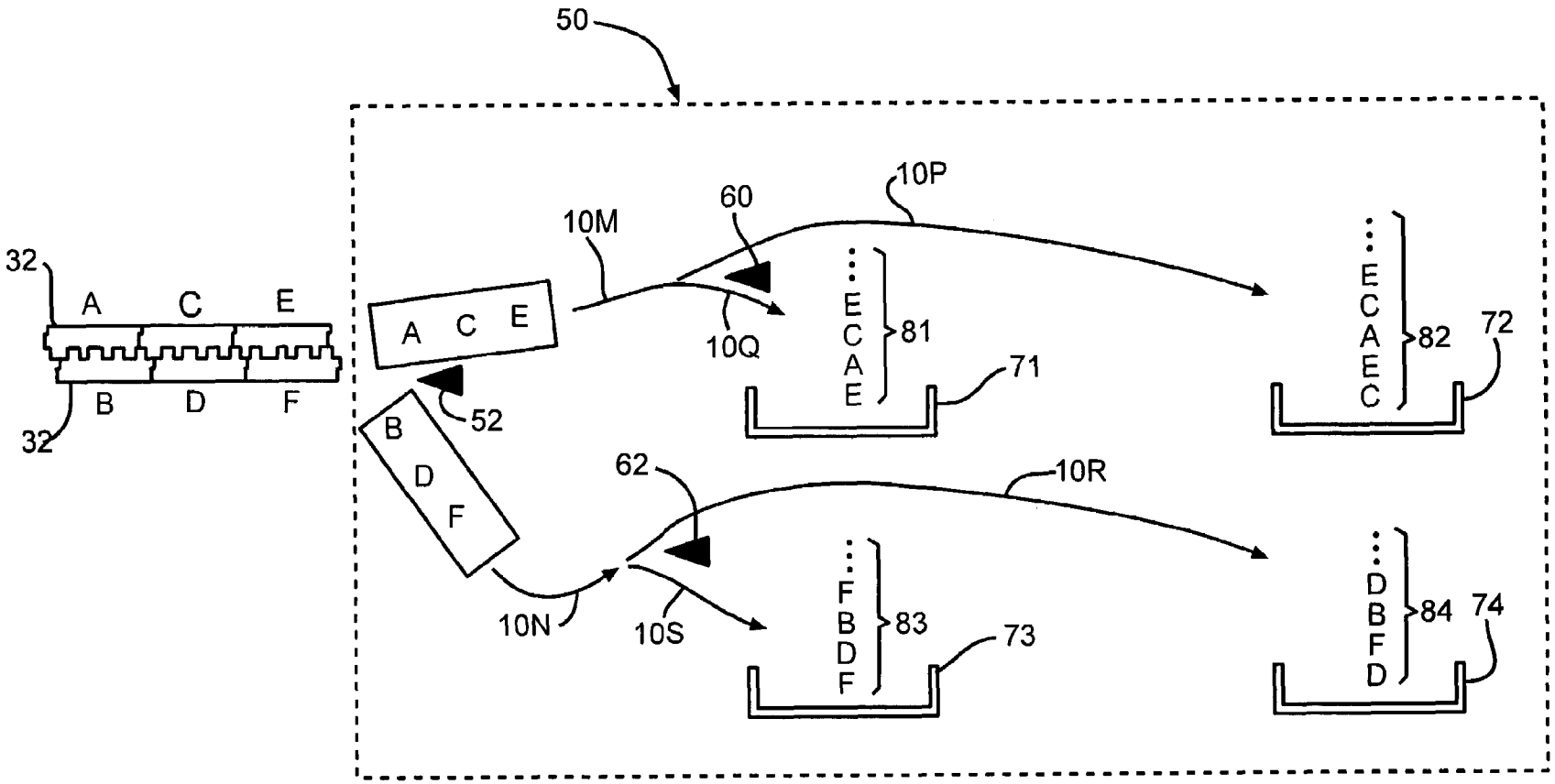
FIG. 10 is a schematic plan view generally, according to the principles of the invention, showing a method of separating and stacking shingles.

FIG. 10 shows an apparatus and a process for separating and stacking shingles made by the three-around repeating cutting cylinder. The apparatus includes a sorting mechanism 50 for separating and stacking shingles. According to the embodiment shown herein, the sorting mechanism 50 includes a first separator 52 for separating, or sorting, a first set of formed shingles 10A, 10C and 10E in a first lane 10M, from a second set of formed shingles 10B, 10D and 10F in a second lane 10N.

A first diverter 60 is positioned downstream from the first lane 10M such that the first diverter 60 divides the first set of shingles into third and fourth lanes 10P and 10Q, respectively. A second diverter 62 is positioned downstream from the second lane 10M such that the second diverter 62 divides the second shingles into fifth and sixth lanes 10R and 10S, respectively.

The first diverter 60 receives and separates, or diverts, every other shingle in the first set (10E, 10C, 10A) into alternating catchers, as generally shown by the arrows. Thus, the shingle 10E is sorted into a first catcher 71, the next shingle 10C is sorted into a second catcher 72, and the subsequent shingle 10A is sorted into the first catcher 71. Thereafter, a subsequent shingle 10E is sorted onto the second catcher 72, and so on.

The second diverter 62 receives and separates, or diverts, every other shingle in the first set (10F, 10D, 10B) into alternating catchers, as generally shown by the arrows. Thus, the shingle 10F is sorted into a third catcher 73, the next shingle 10D is sorted into a fourth catcher 74, and the subsequent shingle 10B is sorted into the third catcher 73. Thereafter, a subsequent shingle 10F is sorted onto the fourth catcher 74, and so on.

The shingles in the first catcher 71 are thus sorted into a first bundle 81 having a first, repeating sequence of 10E, 10A and 10C shingles.

The shingles in the second catcher 72 are thus sorted into a second bundle 82 having a second repeating sequence of 10C, 10E and 10A.

The shingles in the third catcher 73 are thus sorted into a third bundle 83 having a third, repeating sequence of 10F, 10B and 10D.

The shingles in the fourth catcher 74 are thus sorted into a fourth bundle 84 having a fourth, repeating sequence of 10D, 10F and 10B.

In this embodiment, while the first bundle 81 (EAC sequence of shingles) and the second bundle 82 (CEA sequence of shingles) have the same pattern, each bundle starts with a different shingle. Also, in this embodiment, while the third bundle 83 (FBD sequence of shingles) and the fourth bundle 84 (DFB sequence of shingles) have the same pattern, each bundle starts with a different shingle. While the embodiment shown provides only one sequence emanating from the first lane 10M, each bundle that is ultimately produced (i.e., 81, 82) has a different starting point which then gives rise to a "different sequence" in effect. Similarly, while the embodiment shown provides only one sequence emanating from the second lane 10N, each bundle that is ultimately produced (i.e., 83, 84) has a different starting point which then gives rise to a "different sequence" in effect. That is, when the various bundles of shingles are used to cover a roof, there is a more random effect shown and, thus, a greater aesthetic advantage.

In other embodiments, the shingles can be stacked such that the bundles have a different repeating sequence; for example, one bundle can have an "ECA" sequence, and the other have an "AEC" sequence. Such sequence can be accomplished by starting the process by alternating the number of consecutive shingles being first delivered by the first diverter 60 to the first catcher 71 before sorting the subsequent shingles to the second catcher 72 and vise versa.

INDUSTRIAL APPLICABILITY

This invention will be found to be useful in the production of granule coated discrete roofing shingles suitable for use in residential and commercial roofing applications. The present inventive method and apparatus are especially useful for making packages of shingles comprising a first bundle having a first repeating sequence of E, A and C; a second bundle having a second repeating sequence of C, E and A; a third bundle having a third repeating sequence of F, B and D; and, a fourth bundle having a fourth repeating sequence of D, F and B.

The principle and mode of operation of this invention have been described in its preferred embodiments. However, it should be noted that this invention may be practiced otherwise than as specifically illustrated and described without departing from its scope.

What is claimed is:

1. A method for bundling roofing shingles comprising:

forming a plurality of discrete roofing shingles so that at least three patterns of shingles are formed, separating and stacking shingles into multiple bundles of sorted shingles, wherein each bundle of a multiplicity of bundles has a different repeating sequence of the at least three patterns of shingles;

separating a first set of formed shingles from a second set of formed shingles; and positioning a first diverter downstream from the first set of shingles, and positioning a second diverter downstream from the second set of shingles, wherein the first diverter receives and separates shingles in the first set alternatingly into a first catcher and a second catcher; and wherein the second diverter receives and separates shingles in the second set alternatingly into a third catcher and a fourth catcher.

2. The method of claim 1, wherein the first diverter sorts the first set of shingles into a first sequence in the first catcher and into the second sequence in a second catcher, wherein:

a shingle having a first pattern is soiled into the first catcher, a shingle having a second pattern is sorted into the second catcher, a shingle having a third pattern is soiled into the first catcher, a shingle having the first pattern is sorted into the second catcher, a shingle having the second pattern is sorted into the first catcher, a shingle having the third pattern is sorted into the second catcher;

the first sequence in the fast catcher and the second sequence in the second catcher being repeated until bundles having a predetermined number of shingles therein are formed in the first and second catchers; and wherein the second diverter soils the second set of shingles into the third sequence in a third catcher and into a fourth sequence in the fourth catcher:

a shingle having a fourth pattern is sorted into a third catcher, a shingle having a fifth pattern is sorted into a fourth catcher, a shingle having a sixth pattern is soiled into the third catcher, a shingle having the fourth pattern is sorted into the fourth catcher, a shingle having the fifth pattern is soiled into the third catcher, a shingle having the sixth pattern is sorted into the fourth catcher;

the third sequence in the third catcher and the fourth sequence in the fourth catcher being repeated until bundles having a predetermined number of shingles therein are formed in the third and fourth catchers.

3. The method of claim 2, wherein the soiling mechanism soils certain of the shingles into the first bundle having the first repeating sequence of E, A and C, where E, A and C represent different patterned shingles;

certain of the shingles into the second bundle having the second, repeating sequence of C, E and A;

certain of the shingles into the third bundle having the third, repeating sequence of B, D and F, where B, D and F represent different patterned shingles; and, certain of the shingles into the fourth bundle having the fourth, repeating sequence of F, B and D.

4. A method for bundling roofing shingles comprising:

forming a plurality of discrete roofing shingles so that multiple patterns of shingles are formed, and separating and stacking shingles into multiple bundles of sorted shingles, wherein each bundle of a multiplicity of bundles has a different repeating sequence of shingles;

wherein a soiling mechanism is adapted to form four different repeating sequences of shingles.

* * * * *

UNITED STATES PATENT AND TRADEMARK OFFICE

CERTIFICATE OF CORRECTION

PATENT NO. : 7,607,275 B2
APPLICATION NO. : 11/176599
DATED : October 27, 2009
INVENTOR(S) : Elliott et al.

It is certified that error appears in the above-identified patent and that said Letters Patent is hereby corrected as shown below:

Column 8, Claim 2 should read:

Please note words to be corrected in bold:

2. The method of claim 1, wherein the first diverter sorts the first set of shingles into a first sequence in the first catcher and into the second sequence in a second catcher, wherein:

a shingle having a first pattern is sorted into the first catcher, a shingle having a second pattern is sorted into the second catcher, a shingle having a third pattern is sorted into the first catcher, a shingle having the first pattern is sorted into the second catcher, a shingle having the second pattern is sorted into the first catcher, a shingle having the third pattern is sorted into the second catcher;

the first sequence in the first catcher and the second sequence in the second catcher being repeated until bundles having a predetermined number of shingles therein are formed in the first and second catchers; and wherein the second diverter sorts the second set of shingles into the third sequence in a third catcher and into a fourth sequence in the fourth catcher:

a shingle having a fourth pattern is sorted into a third catcher, a shingle having a fifth pattern is sorted into a fourth catcher, a shingle having a sixth pattern is sorted into the third catcher, a shingle having the fourth pattern is sorted into the fourth catcher, a shingle having the fifth pattern is sorted into the third catcher, a shingle having the sixth pattern is sorted into the fourth catcher;

the third sequence in the third catcher and the fourth sequence in the fourth catcher being repeated until bundles having a predetermined number of shingles therein are formed in the third and fourth catchers.

Column 8, & Col. 9, Claim 3 should read:

3. The method of claim 2, wherein the sorting mechanism sorts certain of the shingles into the first bundle having the first, repeating sequence of E, A and C, where E, A and C represent different patterned shingles;

certain of the shingles into the second bundle having the second, repeating sequence of C, E and A;

certain of the shingles into the third bundle having the third, repeating sequence of B, D and F, where B, D and F represent different patterned shingles; and, certain of the shingles into the fourth bundle having the fourth, repeating sequence of F, B and D.

Column 10, Claim 4 should read:

4. A method for bundling roofing shingles comprising:

forming a plurality of discrete roofing shingles so that multiple patterns of shingles are formed, and separating and stacking shingles into multiple bundles of sorted shingles, wherein each bundle of a multiplicity of bundles has a different repeating sequence of shingles;

wherein a sorting mechanism is adapted to form four different repeating sequences of shingles.

Signed and Sealed this

Sixteenth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,607,275 B2
APPLICATION NO. : 11/176599
DATED : October 27, 2009
INVENTOR(S) : Elliott et al.

It is certified that error appears in the above-identified patent and that said Letters Patent is hereby corrected as shown below:

Column 8, lines 29 - 65, Claim 2 should read:

2. The method of claim 1, wherein the first diverter sorts the first set of shingles into a first sequence in the first catcher and into the second sequence in a second catcher, wherein:

a shingle having a first pattern is sorted into the first catcher, a shingle having a second pattern is sorted into the second catcher, a shingle having a third pattern is sorted into the first catcher, a shingle having the first pattern is sorted into the second catcher, a shingle having the second pattern is sorted into the first catcher, a shingle having the third pattern is sorted into the second catcher;

the first sequence in the first catcher and the second sequence in the second catcher being repeated until bundles having a predetermined number of shingles therein are formed in the first and second catchers; and wherein the second diverter sorts the second set of shingles into the third sequence in a third catcher and into a fourth sequence in the fourth catcher:

a shingle having a fourth pattern is sorted into a third catcher, a shingle having a fifth pattern is sorted into a fourth catcher, a shingle having a sixth pattern is sorted into the third catcher, a shingle having the fourth pattern is sorted into the fourth catcher, a shingle having the fifth pattern is sorted into the third catcher, a shingle having the sixth pattern is sorted into the fourth catcher;

the third sequence in the third catcher and the fourth sequence in the fourth catcher being repeated until bundles having a predetermined number of shingles therein are formed in the third and fourth catchers.

Column 8, line 66 - Column 9, line 9, Claim 3 should read:

3. The method of claim 2, wherein the sorting mechanism sorts certain of the shingles into the first bundle having the first, repeating sequence of E, A and C, where E, A and C represent different patterned shingles;

certain of the shingles into the second bundle having the second, repeating sequence of C, E and A;

certain of the shingles into the third bundle having the third, repeating sequence of B, D and F, where B, D and F represent different patterned shingles; and, certain of the shingles into the fourth bundle having the fourth, repeating sequence of F, B and D.

Column 10, Claim 4 should read:

4. A method for bundling roofing shingles comprising:

forming a plurality of discrete roofing shingles so that multiple patterns of shingles are formed, and separating and stacking shingles into multiple bundles of sorted shingles, wherein each bundle of a multiplicity of bundles has a different repeating sequence of shingles;

wherein a sorting mechanism is adapted to form four different repeating sequences of shingles.

This certificate supersedes the Certificate of Correction issued February 16, 2010.

Signed and Sealed this

Twenty-third Day of March, 2010

David J. Kappos

David J. Kappos
*Director of the United States Patent and Trademark Office*